US006397406B1

(12) United States Patent
Moshkovich

(10) Patent No.: US 6,397,406 B1
(45) Date of Patent: Jun. 4, 2002

(54) BIDET ATTACHMENT FOR TOILET SEAT

(76) Inventor: Natan M. Moshkovich, 14416 Chase St., Panorama City, CA (US) 91402

( * ) Notice: Subject to any disclaimer, the term of this patent is extended or adjusted under 35 U.S.C. 154(b) by 0 days.

(21) Appl. No.: 09/769,230

(22) Filed: Jan. 24, 2001

(51) Int. Cl.[7] ..... E03D 9/08
(52) U.S. Cl. ..... 4/420.4
(58) Field of Search ..... 4/420.2, 420.4, 4/447, 448

(56) References Cited

U.S. PATENT DOCUMENTS 2,826,761 A * 3/1958 Lazarus et al. ..... 4/447
4,041,553 A * 8/1977 Sussman ..... 4/447
5,247,711 A * 9/1993 Kwon ..... 4/420.4
5,279,001 A 1/1994 Vento
5,911,516 A 6/1999 Chang
6,073,275 A 6/2000 Klopocinski

FOREIGN PATENT DOCUMENTS

FR 1441525 * 2/1965 ..... 4/420.4

* cited by examiner

*Primary Examiner*—Charles E. Phillips

(57) ABSTRACT

This invention provides a combination of a bidet and toilet and includes a water tubular means, a softsoap tubular means, a nozzle, a liquid container, a first connector, comprising a valve, a second connector providing the handle control of the sprinkling mixture direction, and the holders. The nozzle means comprises the hollow body, having the transversal wall in the middle of the nozzle, separating the softsoap liquid flow and the water flow, and the apertures for the sprinkling stream outlet.

2 Claims, 5 Drawing Sheets

21 - 21

22 - 22

BIDET ATTACHMENT FOR TOILET SEAT

FIELD OF THE INVENTION

The invention relates to a toilet and bidet combination and more particularly to a bidet attachment for the toilet seat.

BACKGROUND OF THE INVENTION

Bidet attachments for toilets are known in the art, and generally include a bidet housing. The one of known toilet and bidet assembly is described in the U.S. Pat. No. 5,911,516. According to this patent the bidet housing of a bidet attachment includes a base plate for mounting on the upper horizontal rim surface of a toilet bowl, and a top cover mounted on the base plate. The bidet housing confines an opening for access into the toilet bowl.

A heating element inside the bidet housing extends around a major part of the opening. A flexible water tube is sheathed on the heating element, and confines a water passage therewith. A water supply valve supplies water to the water passage. Water from the water passage is supplied to a nozzle assembly that is movable between retracted and extended positions. The heating element can be actuated for warming up the bidet housing and for heating water that flows through the water passage from the water supply valve and that flows out of the nozzle assembly.

Each of the first and second water coupling units is mounted on the base plate, and has a water port and a coupling port. The water port of the first water coupling unit is connected to the water inlet pipe. The terminating end portions of the heating element extend respectively into the first and second water coupling units via the coupling ports of the latter.

The flexible water tube has opposite ends secured respectively on the coupling ports of the first and second water coupling units. The coupling ports are wider than the cross-sectional size of the heating element so that water entering into the first water coupling unit can flow into the water passage, and so that water, exiting the water passage can flow into the second water coupling unit.

The nozzle assembly includes a water outlet pipe disposed in the bidet housing and connected to the water port of the second water coupling unit, and a spray pipe disposed below the base plate. The spray pipe has an inlet end that extends into the bidet housing and that is coupled to the water outlet pipe such that the spray pipe is rotatable relative to the water outlet pipe about a horizontal axis between a retracted position, where the spray pipe is disposed adjacent to the base plate, and an extended position, where the spray pipe is adapted to extend into the toilet bowl. The spray pipe further has an outlet end that is provided with a spray nozzle.

The heating element can be actuated for warming up the bidet housing and for heating water that flows through the water passage from the water supply valve and that flows out of the nozzle assembly.

Such bidet attachment for toilet bowls is very complex and expensive.

Another toilet and bidet combined device is presented in the U.S. Pat. No. 6,073,275, wherein A multifunction toilet is shown with a conventional flushing system and auxiliary components which include an odor exhaust system which withdraws gases from the toilet bowl and delivers them to the sewage drain downstream of the toilet water trap. Other auxiliary components include a motor driven retractable nozzle pipe which provides a personal warm water spray rinse and a dryer which supplies warm drying air. The auxiliary components are operated under a switch control system which assures proper sequencing and prevents use unless the user is seated on the toilet seat.

The present invention provides a toilet with auxiliary components which include an odor removing fan and a bidet type genital washing spray with an air dryer. The auxiliary components are regulated by a unique control system which allows the user's choice but assures proper sequential use and prevents actuation when the user is not seated.

The invention provides the multifunction flush toilet with a ventilating system including an exhaust fan for withdrawing gases from the toilet bowl for odor control and delivering the gases to the sewage waste drain downstream from the toilet bowl water trap seal. The exhaust fan can only be turned on by the user when the user is seated on the toilet seat, sitting on the seat actuating an enabling switch. The ventilating system provides a water trap valve assembly which is operated by exhaust gas fan pressure, eliminating electric control for the valve, while providing maximum air flow without restriction in the ventilating air conduit and providing complete shutoff against sewer gas backflow with a water seal.

The present invention also equips the toilet with a motor driven retractable nozzle pipe which provides a bidet type genital washing warm water spray which is user operated to produce a gentle low pressure spray or a higher pressure brisk spray followed by an optional warm drying air flow, all regulated by the unique control system which assures the proper sequence functioning and prevents actuation when the user is not seated.

The multifunction toilet includes a toilet bowl with a flushing ring manifold adjacent the top of the bowl and a water trap seal between the bowl and a siphoned outlet to a sewage waste drain. A toilet seat is mounted on the top of the bowl, and a water supply tank incorporates a flushing mechanism with a valve, control outlet to the flushing ring manifold and a level control which includes an overflow tube in communication with the bowl. The auxiliary components include an exhaust fan which is connected to an air outlet in the toilet bowl for withdrawing gases from the bowl for odor control. An air conduit is connected to the fan and to the sewage waste drain downstream of the bowl water trap seal. A control system includes an enabling switch which is connected to the exhaust fan and activated by the user sitting on the toilet seat and a user on-off switch which is connected to the exhaust fan. The exhaust fan is turned on only when the user is sitting on the toilet seat and the user switches the user on-off switch to an on position An odor extraction trap and valve assembly is connected to the exhaust fan. The assembly has a water sump and a valve with a moving member extending into the sump in a closed position of the valve to prevent backflow of gas from the gas disposal outlet. When the exhaust fan is operating, it creates an air flow from the bowl air outlet, and the air flow will lift the moving valve member to an open valve position creating an air flow path above the water sump. When the exhaust fan is turned off, the moving valve member will return to its closed position. Fresh water is supplied to the sump each time the toilet is flushed from the flushing mechanism.

The exhaust fan has a casing with an air inlet and an air outlet. The air inlet is connected to the air outlet in the toilet bowl. An odor extraction trap and valve assembly which has a housing with an air inlet and an air outlet has its air inlet connected to the air outlet of the fan casing. An air conduit connects the air outlet of the housing to the sewage waste drain downstream of the bowl water trap seal. The lower portion of the trap and valve assembly housing contains a water sump which together with an inlet valve define a water trap valve that is closed when the exhaust fan is not operating with the water in the sump preventing backflow of sewer gas through the housing inlet. The water trap valve is opened when the exhaust fan is operating with air flow from the fan lifting the inlet valve, creating an air flow path from the housing inlet above the water sump and through the housing and housing outlet. The housing air inlet includes a vertically oriented tubular member extending upwardly into the housing through the water sump and terminating in an end defining a water level overflow weir. A valve stem guide sleeve is centrally located in the tubular member, and a moving valve member including a circular top plate having a vertically depending valve stem is movably supported in the guide sleeve. A tubular valve skirt depends from the circular top plate of the moving valve member so as to extend into the sump to form a water seal. When the exhaust fan is operating, the inlet valve is lifted so that the tubular valve skirt is lifted above the water sump creating the air flow path.

The extraction trap and valve assembly further includes an inner ring extending upwardly in the sump concentric with the tubular member and defines with the top plate a valve air chamber when the air flow from the exhaust fan lifts the inlet valve to an open position.

Each time that the toilet is flushed, water is supplied to the sump creating an overflow of water over the overflow weir out of the housing inlet and through the fan casing from the casing air outlet to the casing air inlet and into the toilet bowl through the air outlet in the toilet bowl. The fan casing has a water drain bypass conduit with one end connected to the casing between the casing, air inlet and the fan and the other end of the bypass being connected to the casing between the fan and the casing outlet.

Also, the exhaust fan and the odor extraction trap and valve assembly are located in an integral housing with the exhaust fan being located at the top of the housing and the sump being located at the bottom of the housing.

The auxiliary components of the invention also include a nozzle pipe and a nozzle motor for advancing the nozzle pipe into the bowl from a retracted position outside of the bowl to a use position inside the bowl and for retracting the nozzle pipe from the bowl from the use position to the retracted position. A warm water tank is connected to the nozzle pipe with an electrically operated valve. The control system includes a retracted position limit switch, a use position limit switch, and a two position multifunction user switch. When the user is sitting on the toilet seat and he switches the multifunction user switch from an off position to an on position, power will be supplied to the nozzle motor advancing the nozzle pipe into the bowl, opening the retracted position limit switch, and when the nozzle pipe reaches its use position, the use position limit switch will be closed stopping the motor and opening an electrically operated valve to supply warm water through the nozzle pipe to provide a gentle rinse spray. When the user switches the multifunction user switch from the on position to an off position, the electrically operated valve will be closed, shutting off the spray, and power will be supplied to the nozzle motor retracting the nozzle pipe from the bowl. When the nozzle pipe reaches its retracted position, the retracted position limit switch will be closed shutting off the nozzle motor.

The second electrically operated valve is used connected in parallel with a first electrically operated valve between the warm water tank and the nozzle pipe so that when warm water is being supplied through the nozzle pipe providing a rinse spray, the user can increase the pressure of the spray by depressing and holding the multifunction user switch in its on position, opening the second electrically operated high pressure valve.

The warm air blower is connected to an air inlet in the toilet bowl. When the user is sitting on the toilet seat with the user on-off switch in its on position and the multifunction user switch in its off position with the nozzle pipe in its retracted position, the warm air blower can be turned on to supply drying air by depressing and releasing the multifunction switch in its off position.

The described device is extremely expensive and complex.

The toilet seat bidet assembly by U.S. Pat. No. 5,279,001 includes an upper molded seat portion, a flat base portion structured and disposed for supported positioning atop a rim portion of the toilet bowl, and a central opening, pivotally mounted atop the toilet bowl, and having a hollow channel formed between the upper seat portion and base portion of the toilet seat wherein a pair of flow actuated, pop out cleansing spouts are mounted in spaced apart relation from one another. The spouts are caused to protrude through a side of the upper portion of the toilet seat into the center opening in the toilet seat in response to water pressure so as to disperse water for cleansing a user's intimate parts. The spouts retract and remain protectively concealed within the hollow channel when water flow is stopped so as to shield them from potential contamination.

This invention is directed towards a toilet seat bidet assembly for use on a toilet bowl. The bidet assembly includes primarily a toilet seat which is pivotally mounted atop the toilet bowl. The toilet seat is made up of an upper molded seat portion, a flat base portion structured and disposed for support and positioning atop a rim portion of the toilet bowl, and a central opening. The upper portion and the base portion of the toilet seat are attached to one another so as to form a standard looking toilet seat and form a hollow channel therebetween. Disposed within the hollow channel of the toilet seat are a pair of flow actuated, pop out cleansing spouts. The cleansing spouts are mounted in spaced apart relation from one another so as to maximize the cleansing area, and are positioned so as to extend through the upper portion of the toilet seat into the central opening of the toilet seat when water is flowing therethrough. When water is no longer flowing through the cleansings spouts retract and remain within the hollow channel where they are out of the way of potential contamination. As a result, only when water is flowing through the cleansing spouts, and accordingly, flushing it and keeping it clean from any potential contamination, will the spouts be exposed. In order to deliver water to the cleansing spouts, conduit means are included which connect the cleansing spouts with water inlet means, the water inlet means being connected in fluid flow communication to a water source for receipt of water therethrough.

The described device is extremely expensive and complex and requires the special design of the toilet seat.

Thus, there is a great need in the art for not expensive easy installing bidet attachment for toilet seat.

OBJECT AND ADVANTAGES OF THE INVENTION

Accordingly, several objects and advantages of the present invention are to provide an improved bidet attachment for toilet seat.

It is another object of the invention to provide combination of the improved bidet with the standard toilets.

It is still another object of the invention to provide the toilet and bidet combination without any toilet and toilet seat modifications.

It is further object of the invention to increase convenience of the improved bidet use by possibility to change the angle of the sprinkling stream.

It is still further object of the invention to provide the adjustability of the improved bidet attachment to the any toilet assembly configuration.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

This invention provides a combination of the bidet and toilet. An improved bidet attachment for toilet seat includes a tubular means, a nozzle means, a liquid soap container, a first connector, comprising a valve, a second connector providing the handle control of the sprinkling mixture direction, and the holders. The nozzle means comprises the hollow body (the cylinder, semi-cylinder, square form body or any geometrical configuration can be used), having the transversal (lateral) wall in the middle of the nozzle, separating the liquid soap flow and the water flow, and the apertures for the sprinkling stream outlet.

DESCRIPTION OF THE PREFERRED EMBODIMENTS

Here the description of an improved bidet attachment for the toilet seat will be done in statics (as if the components of the improved device are suspended in the space) with description of their relative locations and connections to each other. The description of the functional operations of the improved bidet attachment will be done hereinafter.

Figure 1:
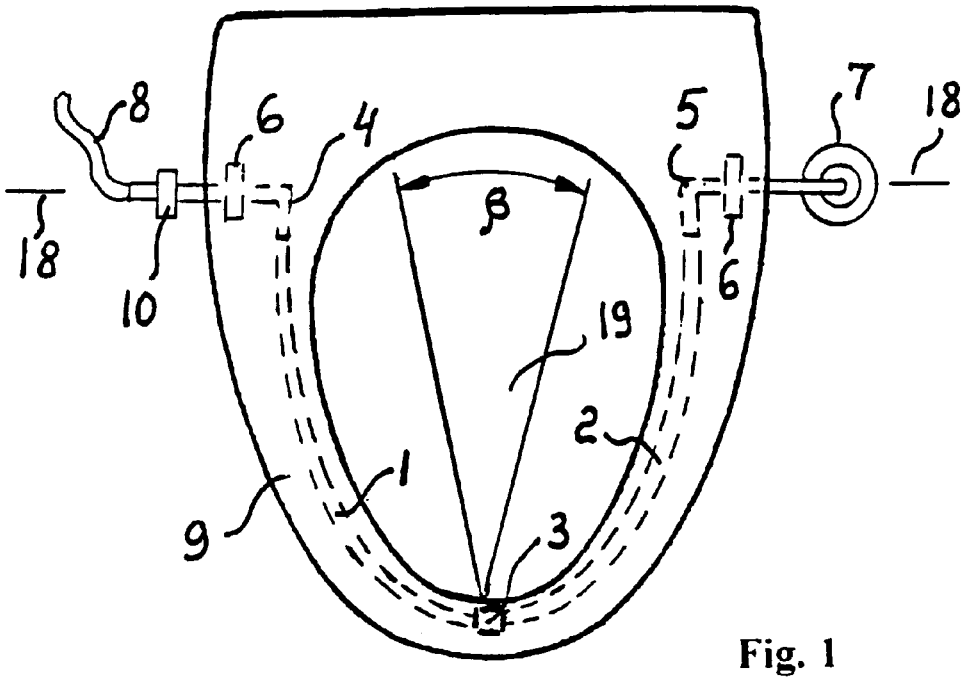
FIGS. 1, 2 are the simplified representation of the improved bidet and toilet combination assembly and its projection respectively.
Figure 2:
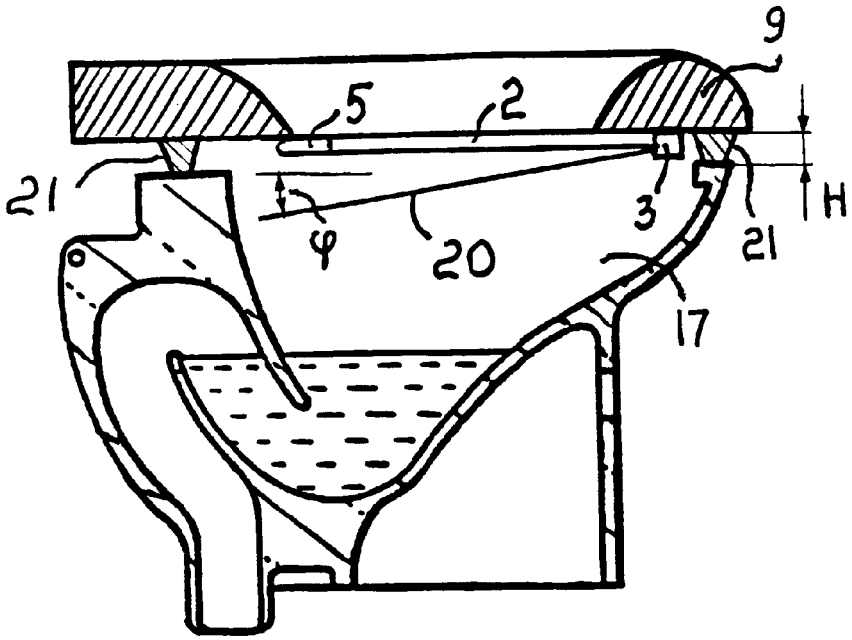
Figure 3:
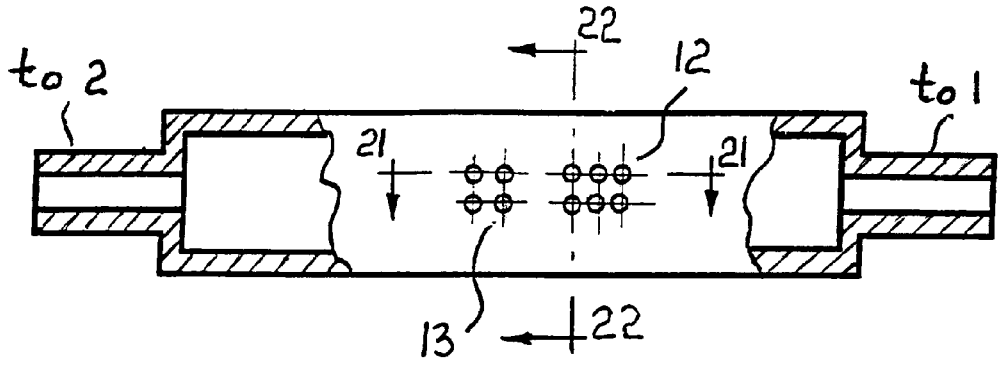
FIG. 3 is a simplified drawings of the nozzle.
Figure 4A:
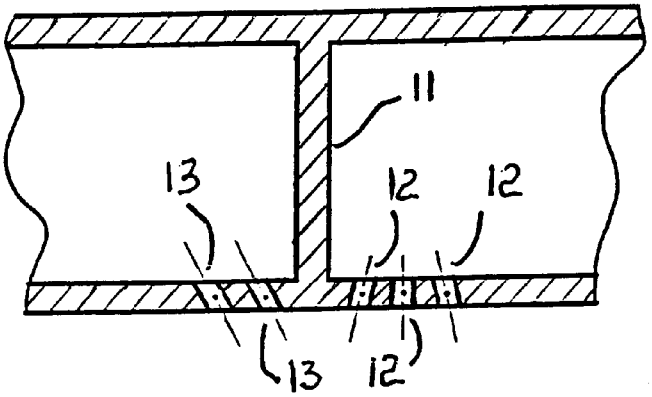
FIGS. 4*a*, 4*b* are the simplified nozzle cross-sectional views.
Figure 4B:
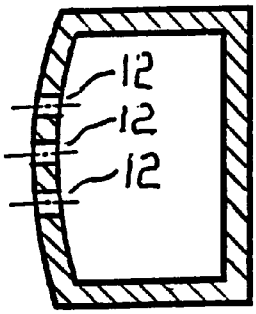
Figure 5:
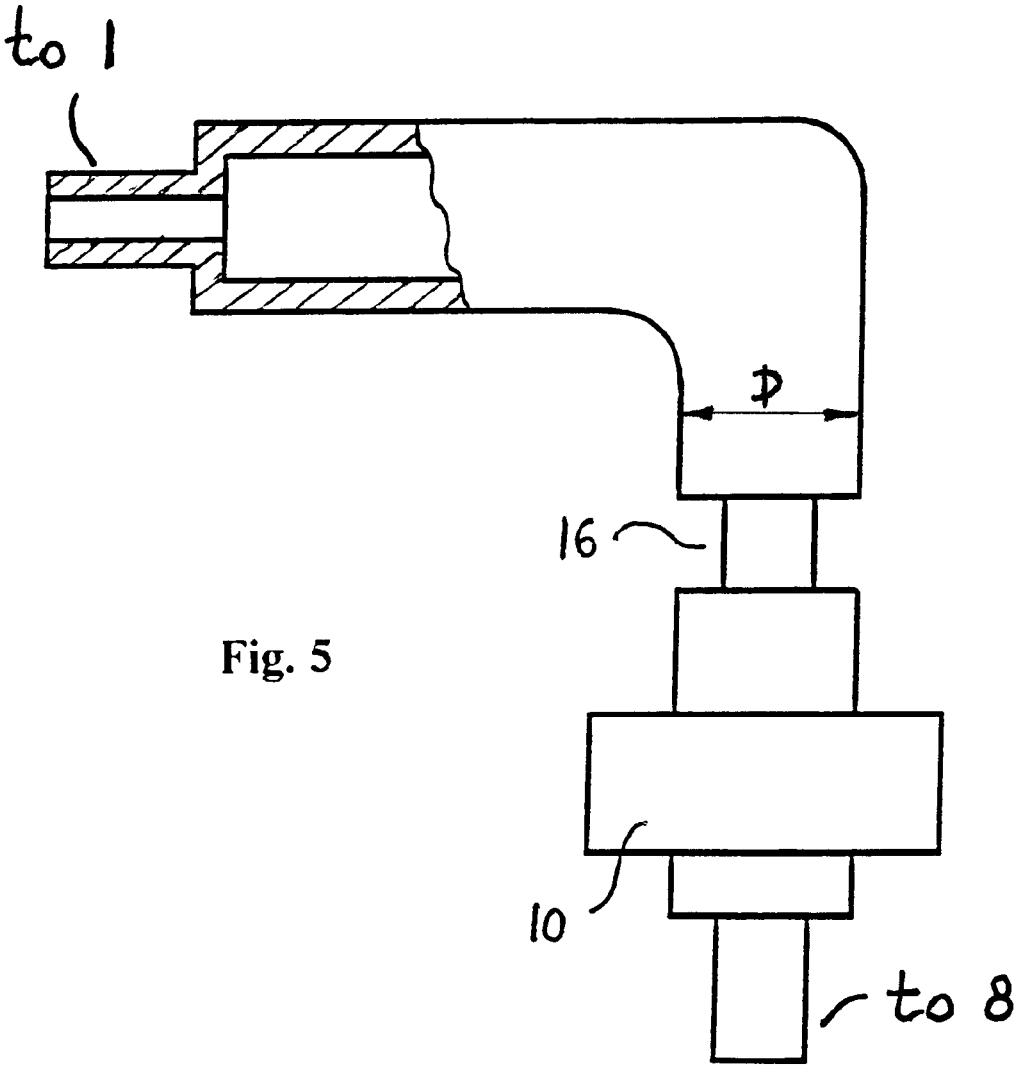
FIG. 5 is a simplified drawings of the first connector.
Figure 6A:
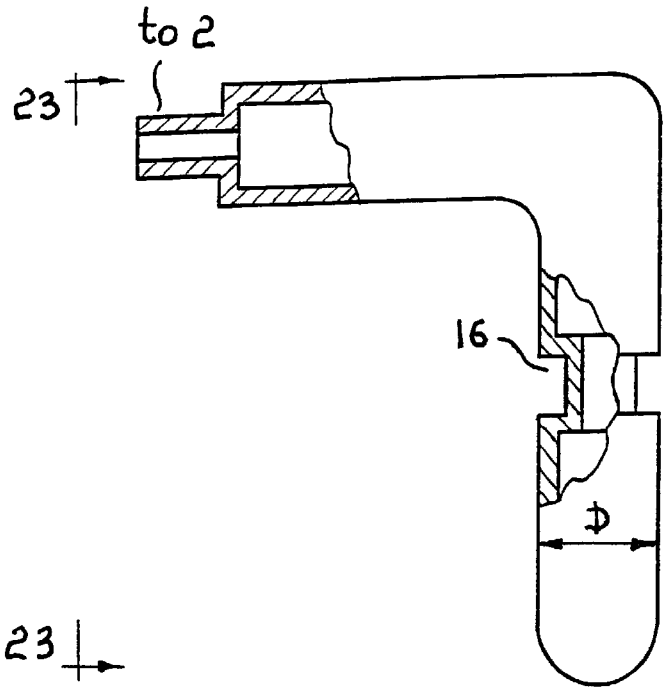
FIGS. 6*a*, 6*b* are the simplified drawings of the second connector and its projection respectively.
Figure 6B:
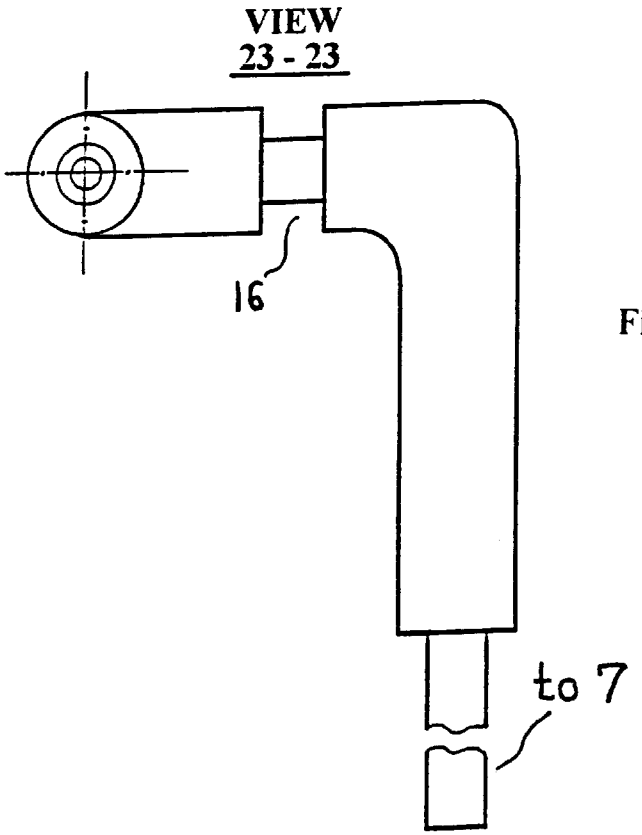
Figure 7A:
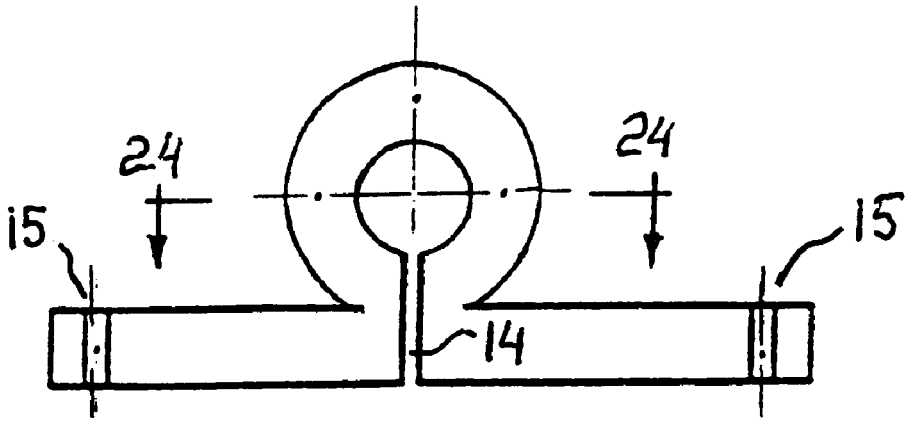
FIGS. 7*a*, 7*b* are the simplified drawings of the holder and its cross-sectional view respectively.
Figure 7B:
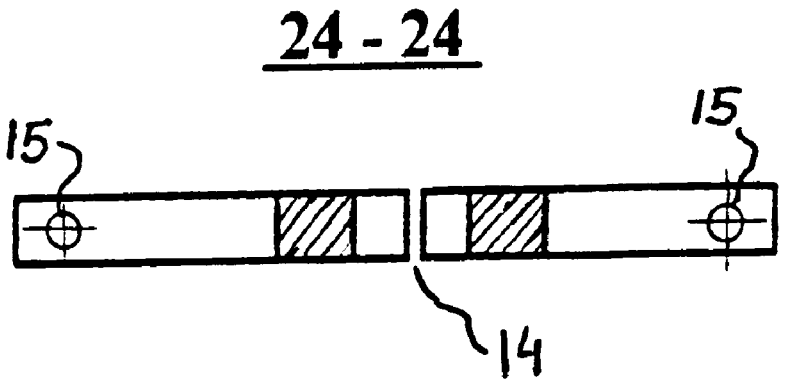

Referring to FIGS. 1 and 2, an improved bidet attachment for toilet seat includes a water tubular means 1 coupling a first connector 4 (see also FIG. 5) with a nozzle 3 (see also FIGS. 3, 4*a*, 4*b*), a liquid soap tubular means 2 coupling a second connector 5 (see also FIGS. 6*a*, 6*b*) with the nozzle 3. The second connector 5 also has non-leaking connection with a liquid soap container 7. The first 4 and second 5 connectors have the slots 16 (see FIGS. 5, 6*a*, 6*b*) to be installed into holders 6, which provide the connection (by the connection apertures 15, as shown on FIGS. 7*a*, 7*b*) of the improved bidet attachment assembly to the toilet seat 9. The first connector 4 is connected to the water line by a water line tubular means 8. As shown on FIG. 5, the first connector 4 includes a controllable valve 10, providing water access into the water tubular means 1 (for example, the control can be provided by hand-operating valve handle). Each holder 6 has a slit 14 (see FIGS. 7*a*, 7*b*), providing an adjustment for non-tight attachment of the appropriate connector (connector 4 or connector 5 respectively) inside the holder 6, thereby providing the bidet assembly connection to the toilet seat. The non-tight connection provides a pivotability of the connectors 4 and 5 inside the appropriate holders 6.

The improved bidet attachment operates as follows. The water flowing from the water line tubular means 8 to the first connector 4 is controlled by the controllable valve 10. Water through the first connector 4 and water tubular means 1 flows in the nozzle 3 and is sprinkled through the water outlet apertures 13 in the toilet bowl of the toilet 17. The angle of the sprinkling stream is controlled by the bidet assembly inclination provided by the pivotability of the connectors 4 and 5 in the holders 6. For example, the person, using the bidet, moves the liquid soap container 7 from its initial vertical position counterclockwise at the needed (convenient) angle, thereby counterclockwise moving (rotating around an axis 18) the bidet assembly including the nozzle 3 from its initial position at the chosen (convenient) angle. The chosen angle can have variation, for example, within 0°–180°. The sector 19 of the sprinkling stream can have, for example, angle $\beta$=25°–35°. The nozzle 3 can have an adjustable construction (pivotable in the tubular means 1 and 2 /non-fixedly (hingedly) connected (not shown) to the tubular means 1 and 2/) or can be fixedly (rigidly) connected to the tubular means 1 and 2. In FIG. 2 is shown the initial position of the nozzle 3, providing the angle $\phi$ (the angle of the sprinkling stream direction 20) equal, for example, about 5°–7° in order to prevent the accidental water spillage over the toilet bowl at the time of the water valve 10 accidental turning-on, when the toilet seat is not occupied. All mentioned above angles can vary in dependence on the individual convenience. The convenient direction 20 and sector 19 of the sprinkling stream can be provided by the adjustment of the nozzle 3 or by interchangeability—of the nozzles, having different set and angles of the water outlet apertures 12. The diameter "D" (see FIGS. 5, 6*a*, 6*b*) of the first 4 and second 5 connectors is smaller than the height "HI" (D<H) of the toilet seat rests 21, shown on FIG. 2. Also the improved bidet attachment can have solid (uninterrupted) tubular construction (with no components such as nozzle 3, tubular means 1 and 2, connectors 4 and 5), bent in the same configuration as presented on FIG. 1 and having a separator between apertures 12 and 13 in the middle of the solid tubular construction. The apertures 12 and 13 can be drilled, for example, in the solid tubular construction.

In order to sprinkle the mixture of the water with the liquid soap the occupied toilet seat person moves (incline) the liquid soap container 7 at any angle over 90° and presses the container 7. The strength of water and/or mixture stream is provided by the valve 10 control. Thus, an improved bidet attachment provides the convenience of the toilet use as bidet and toilet combination.

CONCLUSION, RAMIFICATION AND SCOPE

Accordingly the reader will see that, according to the invention, I have provided non-expensive and easy installing bidet attachment for toilet seat. An improved bidet attachment has various possibilities, considering possibility to be attached to the already installed toilets without any toilet modifications.

While the above description contains many specificities, these should not construed as limitations on the scope of the invention, but as exemplification of the presently-preferred embodiments thereof Many other ramifications are possible within the teaching to the invention. For example, an improved bidet attachment can be successfully used in the hospitals, nursery and retired houses.

THE DRAWLING REFERENCE NUMERALS WORKSHEET

1.—a water tubular means;
2.—a softsoap liquid tubular means;
3.—a nozzle means;
4.—a first connector;
5.—a second connector;
6.—a holder;
7.—a softsoap liquid container;
8.—a water line tubular means;
9.—a toilet seat;
10.—a controllable valve;
11.—a nozzle wall;
12.—a water outlet aperture;
13.—a softsoap liquid outlet aperture;
14.—a slit;
15.—a connection aperture;
16.—a slot;
17.—a toilet;
18.—an axis;
19.—a sector of the sprinkling stream;
20.—a sprinkling stream direction;
21.—a toilet seat rest.

What is claimed is:

1. A bidet attachment to a toilet seat including:

a solid tubular means positioned under a front portion of said toilet seat and connected to a liquid soap container, which is initially positioned vertically, and through a controllable valve to a water line, and wherein said solid tubular means includes a separator, separating water flow and liquid soap flow, said solid tubular means having water outlet apertures located on the water flow side of said solid tubular means in the area of said separator and liquid soap outlet apertures located on the liquid soap flow side of said solid tubular means in the area of said separator, a first holder and a second holder coupling said solid tubular means with said toilet seat, and wherein each of the holders is fixedly connected to respective sides of said toilet seat, and each include a slit, providing pivotability of said solid tubular means in the holders around an axis passing through the holders by rotation of said liquid soap container.

2. A bidet attachment to a toilet seat, including:

a nozzle means positioned under a front portion of said toilet seat and connected to a front end of a water tubular means and to a front end of a liquid soap tubular means, wherein said nozzle means has a hollow body with a wall transversely separating said hollow body for a water flow portion on one side of said wall and a liquid soap flow portion on the other side of said wall, and wherein the water flow portion of said hollow body of said nozzle includes water outlet apertures located in the area of said wall and said liquid soap flow portion of said hollow body of said nozzle includes liquid soap outlet apertures located in the area of said wall;

a first connector connected to a rear end of said water tubular means and through a controllable valve to a water line;

a second connector connected to a rear end of said liquid soap tubular means;

a first holder coupling said first connector with said toilet seat, wherein said first holder is fixedly connected to said toilet seat, and including a slit providing a non-fixed housing of said first connector in said first, holder and pivotability of said first connector, comprising a slot, inside said first holder;

a second holder appropriately coupling said second connector with said toilet seat, wherein said second holder is fixedly connected to said toilet seat, and including an appropriate slit providing an appropriate non-fixed housing of said second connector in said second holder and pivotability of said second connector, comprising an appropriate slot, inside said second holder;

a liquid soap container connected to said second connector and initially positioned vertically, and wherein said liquid soap container is pivotable around an axis passing through the holders.

* * * * *